US006117051A

United States Patent [19]

Suarez et al.

[11] Patent Number: 6,117,051

[45] Date of Patent: Sep. 12, 2000

[54] EXERCISE BENCH

[75] Inventors: Benjamin D. Suarez; Frank Campitelli, both of Canton; Greg A. DeMatteis, Uniontown, all of Ohio

[73] Assignee: Suarez Corporation Industries, N. Canton, Ohio

[21] Appl. No.: 09/228,738

[22] Filed: Jan. 12, 1999

Related U.S. Application Data

[60] Provisional application No. 60/072,996, Jan. 29, 1998, provisional application No. 60/074,405, Feb. 11, 1998, and provisional application No. 60/087,278, May 29, 1998.

[51] Int. Cl.[7] ..... A63B 22/04

[52] U.S. Cl. ..... 482/51; 52/142

[58] Field of Search ..... 108/91, 53.1, 53.3, 108/186; 446/168, 173, 476; 482/51, 52, 130, 142, 144

[56] References Cited

U.S. PATENT DOCUMENTS

| | | | |
|---|---|---|---|
| D. 181,560 | 11/1957 | Varnado, Sr. . | |
| D. 198,679 | 7/1964 | Cartner . | |
| D. 271,256 | 11/1983 | McClelland . | |
| D. 287,283 | 12/1986 | Johnson . | |
| D. 323,537 | 1/1992 | Wilkinson . | |
| D. 330,057 | 10/1992 | Saunders et al. . | |
| D. 330,234 | 10/1992 | Saunders et al. . | |
| 2,933,850 | 4/1960 | Martin . | |
| 3,035,671 | 5/1962 | Sicherman . | |
| 3,081,085 | 3/1963 | Girolamo | 482/144 |
| 3,630,157 | 12/1971 | Ortenblad . | |
| 3,743,283 | 7/1973 | Garrett . | |
| 4,203,525 | 5/1980 | Okubo . | |
| 4,301,766 | 11/1981 | Piccone . | |
| 4,340,218 | 7/1982 | Wilkinson . | |
| 4,561,652 | 12/1985 | Wilkinson . | |
| 4,648,593 | 3/1987 | Wilkinson . | |
| 4,659,075 | 4/1987 | Wilkinson . | |
| 4,676,501 | 6/1987 | Hoagland et al. . | |
| 4,678,234 | 7/1987 | Wilson . | |
| 4,715,296 | 12/1987 | Wilkinson . | |
| 4,826,158 | 5/1989 | Fields, Jr. . | |
| 4,844,199 | 7/1989 | Nimz . | |
| 5,014,818 | 5/1991 | Schulz . | |
| 5,050,861 | 9/1991 | Thomas et al. . | |
| 5,116,044 | 5/1992 | Wilkinson et al. . | |
| 5,125,646 | 6/1992 | Wilkinson . | |
| 5,158,512 | 10/1992 | Irwin et al. . | |
| 5,169,360 | 12/1992 | Saunders . | |
| 5,184,987 | 2/1993 | Wilkinson . | |
| 5,213,554 | 5/1993 | Goldstein et al. . | |
| 5,234,396 | 8/1993 | Wilkinson . | |
| 5,269,735 | 12/1993 | Pfitzenmeier . | |
| 5,290,210 | 3/1994 | Hana et al. | 482/52 |
| 5,318,489 | 6/1994 | Irwin . | |
| 5,320,592 | 6/1994 | Olshansky et al. | 482/142 |
| 5,441,466 | 8/1995 | Piaget et al. . | |
| 5,591,105 | 1/1997 | Dalebout et al. . | |
| 5,645,511 | 7/1997 | Le Roux et al. . | |

FOREIGN PATENT DOCUMENTS

| | | |
|---|---|---|
| 901614 | 5/1972 | Canada . |

*Primary Examiner*—Jerome Donnelly
*Attorney, Agent, or Firm*—Pearne & Gordon LLP

[57] ABSTRACT

An exercise bench assembly having at least one leg block and a platform. The leg block has a pair of opposing laterally directed projections and the platform has a pair of projection receiving slots for respectively receiving the projections so that the platform can be supported by the leg block. The projections and the projection receiving slots have cooperating arcuate shapes to allow rotation of the platform with respect to the leg block.

32 Claims, 1 Drawing Sheet

EXERCISE BENCH

This application claims the benefit of U.S. Provisional application Ser. No. 60/072,996, filed Jan. 29, 1998, U.S. Provisional application Ser. No. 60/074,405, filed Feb. 11, 1998, and U.S. Provisional application Ser. No. 60/087,278, filed May 29, 1998.

BACKGROUND OF THE INVENTION

The present invention generally relates to exercise equipment and, more specifically, to an adjustable exercise bench assembly for use in aerobic exercises and/or weight training.

It is known in exercising to use a platform for conducting stepping or climbing exercises to increase strength, develop body tone and improve cardiovascular endurance. It is also known to use a bench in conjunction with weight training. However, there are presently no devices that are adequately designed for use both as a stepper platform and a weight training bench.

The prior art stair simulating platforms for stepping exercises have a number of disadvantages. Many platforms have a fixed height and are not suited to people of different heights. Also, the intensity of the physical workout, which is proportional to the platform's height, is not readily altered with a fixed height platform. Some adjustable height stepper platforms are available, however, most of these are not stable and/or their construction is prone to collapse. In addition, almost all of the adjustable height platforms cannot be placed on a incline stably enough for exercise use. An inclined platform is usually not desirable for stepping exercises, but is desirable for weight training.

Although benches for use in weight training are typically very stable, they tend to have a height too high for use as a stepper platform. They also tend to have a cushioned surface that may result in injury if used as a stepper platform. Weight training benches are also heavy, bulky, and difficult to disassemble and store. Some weight training benches can be inclined, but not in a simple and fast manner.

SUMMARY OF THE INVENTION

The present invention overcomes these disadvantages by providing an exercise bench assembly having at least one leg block and a platform. The leg block has two opposing laterally directed projections and the platform has a pair of projection receiving slots in communication with a lower edge of the platform. Each slot is adapted to receive one of the laterally directed projections so that the platform is supported by the leg block.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS OF THE INVENTION

Figure 1:
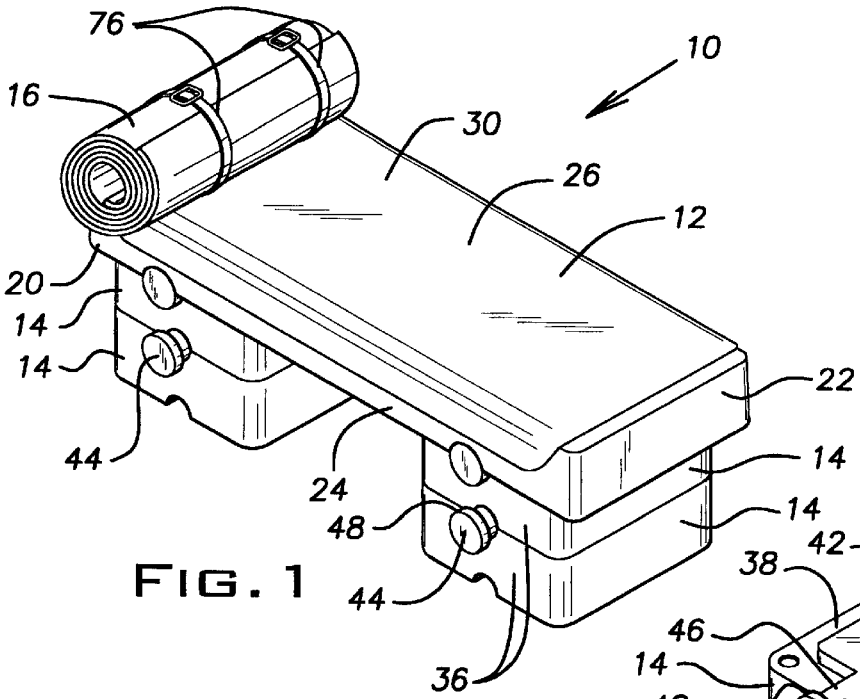
FIG. 1 is a perspective view an exercise bench assembly according to the present invention.

In the detailed description which follows, identical components have been given the same reference numerals, and, in order to clearly and concisely illustrate the present invention, certain features may be shown in somewhat schematic form. When a preferred range, such as 5 to 25, is given, this means preferably at least 5 and preferably not more than 25.

Referring to FIG. 1, the present invention provides an exercise bench assembly 10. The exercise bench assembly 10 includes a bench top, or platform 12, a plurality of leg blocks 14 and optionally a cushion, or mat 16. The platform 12 and the leg blocks 14 are preferably made from molded plastic, such as high density polyethylene. Molding techniques such as injection molding and rotational molding are suitable for these articles. The platform 12 and the leg blocks 14 preferably have hollow, spaced apart walls, as is well known in the art of molded plastic article manufacture. Structural ribs or honeycombs can be disposed in the walls to add rigidity and strength to the platform 12 and leg blocks 14. The exterior surfaces of the platform 12 and the leg blocks 14 are preferably textured to increase the frictional properties of the surfaces and to enhance the bench assembly's appearance.

Figure 4:
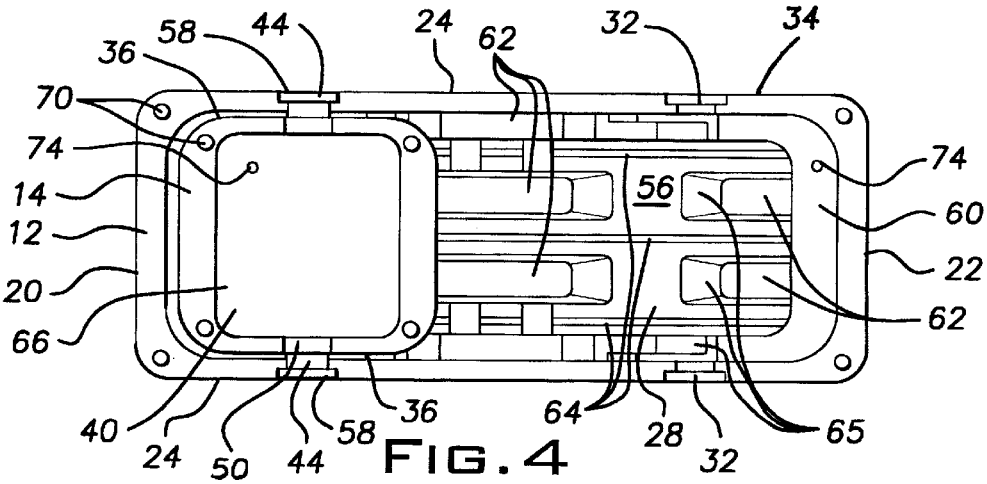
FIG. 4 is a bottom view of the exercise bench assembly with one leg block.

The platform 12 is generally rectangular and has a first end 20, a second end 22, side walls 24, a top surface 26 and a bottom 28 (FIG. 4). The platform 12 is preferably about 30 to 50 inches long, more preferably about 41 inches long and about 10 to 16 inches wide, more preferably 14.5 inches wide. The top surface 26 is preferably provided with a non-slip pad 30. The non-slip pad 30 is preferably made of rubber having a series of small ribs on its upper surface and is secured to the top surface 26 of the platform 12 with adhesive. To enhance adhesion of the non-slip pad to the platform 12, the top surface 26 of the platform 12 in the region where the non-slip pad 30 is applied is preferably smooth, rather than textured.

Figure 3:
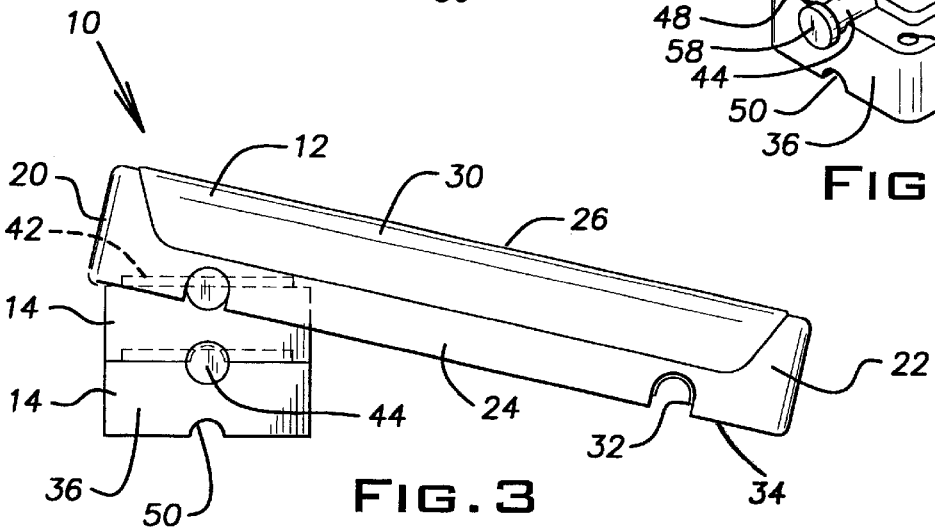
FIG. 3 is a front view of the exercise bench assembly in an inclined position.

With additional reference to FIGS. 3 and 4, the side walls 24 of the platform 12 are provided with arcuate notches, or cutouts, so that the side walls define projection receiving slots 32 at the lower edges 34 of the platform 12. As shown in FIG. 3, the slots 32 are in communication with the lower edge 34 of the platform 12 and are disposed adjacent the first end 20 and the second end 22.

Figure 2:
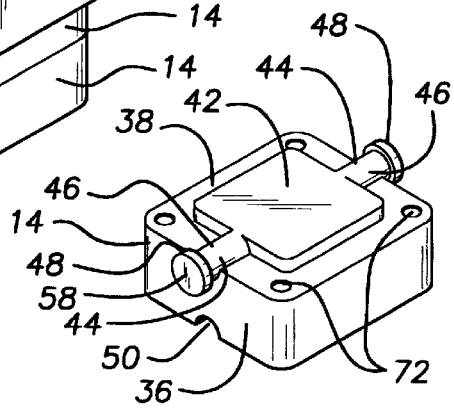
FIG. 2 is a perspective view of a exercise bench leg block according to the present invention.

With additional reference to FIG. 2, the leg blocks 14 are generally square and have side surfaces 36, an upper surface 38 and a lower surface 40 (FIG. 4). The upper surface 38 of the leg blocks 14 are provided with a raised boss 42. The leg blocks 14 are also provided with two opposing laterally directed projections 44 extending from opposite side surfaces 36. The projections 44 are preferably arcuate (e.g., having an overall cylindrical form and a circular cross-section) and the top of the projections 44 are preferably disposed in the same plane as the top of the boss 42. Accordingly, the projections 44 have an arcuate upper region 46 disposed between the edge of the boss 42 and the side surfaces 36. As can be seen, region 46 can also be described as a portion of a cylinder. Ends of the projections 44 are preferably and optionally provided with an end cap, or a shoulder portion 48. The shoulder portion 48 is preferably defined by an enlarged portion of the projection 44 where the diameter of the shoulder portion 48 of the projection 44 is larger than the diameter of the remainder of the projection 44. The side surfaces 36 of the leg blocks 14 are also provided with projection receiving channels 50 at the lower edges of the leg blocks 14. As shown in FIGS. 2 and 3, the channels 50 are in communication with the lower edge of the leg blocks 14 and are vertically aligned with the projections 44. As one skilled in the art will appreciate, the projections 44 can alternatively extend from the side surfaces 36 such that the top of the projections 44 are lower than the top of the boss 42 and unraised portion of the upper surface 38. This alternate arrangement eliminates the need for a projection receiving channel 50 in the side surfaces 36 of the leg blocks 14.

Referring to FIG. 4, the bottom 28 of the platform 12 is preferably provided with a hollowed-out region, or cavity 56. The cavity 56 not only reduces the amount of plastic required to construct the platform 12, but also provides a receiving area for the leg blocks 14. Accordingly, the cavity 56 is laterally sized to accommodate the leg blocks 14 such that when the projections 44 are disposed in the projection receiving slots 32 the end surfaces 58 of the projections 44 are relatively flush with the side walls 24 of the platform 12. The projection receiving slots 32 are contoured to receive both the shoulder portion 48 and the unshouldered portions of the projections 44. Less preferably, the ends of projections 44 may terminate short of, or beyond, the outer surfaces of the side walls 24. Abutment surfaces 60 are preferably provided inside the hollowed-out region 56 adjacent the first end 20 and the second end 22 respectively. The abutment surface 60 allows the platform 12 to rest on the upper surface 38 of the leg block 14 and receive the raised boss portion 42 of the upper surface 38 further into the platform 12. As one skilled in the art will appreciate, the interaction of the platform's features with respective leg block features provides for a stable and easily assembled bench assembly 10. More specifically, the respective interacting features include the slots 32 receiving the projections 44, the cavity 56 receiving the exterior dimensions of the leg blocks 14, and the abutment surface 60 receiving the upper surface 38 of the leg block 14 and boss 42.

The bottom 28 of the platform 12 is preferably provided with structural ribs 62 and gussets 64 inside the hollowed-out cavity 56. The ribs 62 and gussets 64 add strength to the platform 12, especially in areas where the platform 12 is most likely to be stepped on such as the center and the ends 20,22 of the platform. Advantageously, some of the ribs 62 preferably have a height dimension so the ribs 62 contact the boss 42.

The foregoing arrangement minimizes lateral and horizontal shifting of the platform 12 with respect to the leg blocks 14 while providing vertical support to the platform 12 distributed over a relatively large area of the leg blocks 14. Although the platform 12 and the leg blocks 14 are sized to securely fit together, they are also sized to allow rotation with respect to one another, as shown in FIG. 3. Even when rotated with respect to one another, the platform 12 and the leg blocks 14 maintain most of the above-described interaction between the platform 12 and the leg blocks 14 thereby maintaining lateral and horizontal stability of the bench assembly 10. The arcuate shape of the projections 44 and the slots 32 is instrumental in allowing this rotation while eliminating any need for mechanical parts. The ribs 62 are positioned, and have sloped ends 65, so as to provide clearance for the leg block 14 as the platform 12 rotates with respect to the leg block 14. The ability of the platform 12 to rotate with respect to the leg blocks 14 allows the platform 12 to be inclined by placing a different number of leg blocks 14 (such as 1, 2, 3, or 4 leg blocks) under each of the first end 20 and/or the second end 22 of the platform 12.

The legs blocks 14 are also designed to stack upon one another in a secure manner. More specifically, the lower surface 40 of the leg blocks 14 are provided with a recess 66 for receiving the boss 42 of another leg block 14. The channel 50 is sized to accommodate the arcuate upper portion 46 of the projection 44, allowing the perimeter of the lower surface 40 to bear on the unraised upper surface 38 of the leg block 14 below.

Referring to FIG. 4, the platform 12 and leg blocks 14 are preferably provided with rubber feet 70 for added traction and to prevent marring of floor surfaces. The feet 70 are secured to the platform 12 and leg blocks 14 with adhesive. The upper surface 38 of the leg blocks 14 are provided with recesses 72 (FIG. 2) to accommodate the feet 70 of the leg block 14 above when they are stacked.

With continued reference to FIG. 4, the platform 12 and leg blocks 14 are preferably provided with small weep holes 74 to allow air to escape from the hollow, spaced apart walls when the platform 12 and leg blocks 14 are placed under compression during a stepping exercise. Without the weep holes 74, the air inside the platform 12 and leg blocks 14 will have a tendency to cause the spaced walls to spring back after compression. This may result in the bench assembly 10 feeling unsecure under foot.

As shown in FIG. 1, the exercise bench assembly 10 is provided with the mat 16. The mat 16 is preferably rectangular and rolled up to form a cylinder shaped cushion as illustrated. The mat 16 is preferably made from a closed cell polymeric foam. The polymer is of suitable strength such as polyurethane. The surfaces of the mat 16 are preferably brushed. The mat 16 is held in the cylindrical shape, as illustrated, by straps 76 outfitted with adjustable strap fasteners or a strip having a hook and loop type fastener. The mat 16 can be unrolled for use as an exercising pad. In its rolled position, the mat 16 can be used as a body support for weight training exercises. For instance, the mat 16 can be placed under a head while conducting lying lifts such as dumbbell flys or under knees and thighs while conducting sitting lifts such as leg extensions. As one skilled in the art will appreciate, the mat 16 can be made from other materials, such as a cylindrical cushion or a plastic tube.

As stated, the exercise bench assembly 10 can be configured in various arrangements for various exercises. The platform 12 can be used by itself as a stair simulating platform for stepping exercises. To increase the intensity of a physical workout while using the platform 12 for stepping exercises, one or more leg blocks 14 can be placed under the first end 20 and the second end 22 of the platform, as illustrated in FIG. 1. When elevated from the ground by leg blocks 14 in this manner, the bench assembly 10 can be used as a weight training bench for exercises such as flys, bench presses and the like. The platform 12 can also be placed in varying degrees of inclination by placing one or more leg blocks 14 under the first end 20 of the platform, or by placing a different number of leg blocks 14 under each of the first end 20 and the second end 22 of the platform 12. In the inclined position the bench assembly 10 can be used for weight training exercises such as flys or for sit-up type exercises such as crunches or tucks.

Although particular embodiments of the invention have been described in detail, it is understood that the invention is not limited correspondingly in scope, but includes all changes and modifications coming within the spirit and terms of the claims appended hereto.

What is claimed is:

1. An exercise bench assembly comprising a first leg block having a top, a bottom and two opposing laterally directed projections, a second lea block having a top and a bottom, and a platform having a first pair of projection receiving slots, each slot in communication with a lower edge of the platform and adapted to receive one of the laterally directed projections of the first block so that the platform can be supported by said first leg block, said first leg block and said second leg block being adapted to cooperate with each other so that the second lea block is stackable beneath and mechanically interlockable with said first leg block.

2. The exercise bench assembly according to claim 1, wherein said second lea block has a first interlocking element and said first leg block has an interlocking element adapted to cooperate with said first interlocking element of said second lea block so that said second leg block is stackable beneath and mechanically interlockable with said first leg block.

3. The exercise bench assembly according to claim 2, wherein said first interlocking element of said second lea block is a raised boss on the top of said second leg block and the interlocking element of said first leg block is a boss receiving recess on the bottom of said first leg block.

4. The exercise bench assembly according to claim 1, wherein each slot and its corresponding projection have cooperating arcuate shares, the arcuate shares being effective to allow rotation of the platform with respect to said first lea block.

5. The exercise bench assembly according to claim 1, wherein each projection has a shoulder portion.

6. The exercise bench assembly according to claim 5, wherein each projection receiving slot is contoured to receive a shoulder portion.

7. The exercise bench assembly according to claim 1, further comprising a cushion attached to said platform.

8. The exercise bench assembly according to claim 1, wherein a bottom of the platform defines a cavity sized to receive an upper surface of said first leg block.

9. The exercise bench assembly according to claim 1, wherein the upper surface of said first leg block has a raised boss.

10. The exercise bench assembly according to claim 1, further comprising third and fourth leg blocks.

11. The exercise bench assembly according to claim 10, wherein said four leg blocks can be stacked so as to support a first end of the platform, and wherein a second end of the platform is supported by a ground.

12. The exercise bench assembly according to claim 7, wherein said cushion is a rolled-up mat attached to one end of said platform.

13. The exercise bench assembly according to claim 6, wherein said platform has four side walls having outer surfaces, and wherein each shoulder portion does not extend beyond the outer surface of its respective side wall.

14. The exercise bench assembly according to claim 1, wherein said first leg block has an upper surface having a raised boss and a lower surface having a boss receiving recess.

15. An exercise bench assembly according to claim 1, said platform having a first end and a second end, said platform having a first portion adjacent said first end and a second portion adjacent said second end, said second portion having a bottom, said first pair of slots being provided in said first portion, said second portion having an interlocking element adapted to cooperate with said second leg block so that said second portion can be supported by and mechanically interlocked with said second leg block.

16. An exercise bench assembly according to claim 15, wherein the interlocking element of the second, portion is a recess in the bottom of the second portion adapted to receive all or a portion of the top of said second leg block.

17. An exercise bench assembly according to claim 1, further comprising a third leg block having a top and a bottom, said second leg block and said third leg block being adapted to cooperate with each other so that the third leg block is stackable beneath and mechanically interlockable with said second leg block.

18. An exercise bench assembly according to claim 17, wherein said third leg block has a first interlocking element and said second leg block has a second interlocking element adapted to cooperate with said first interlocking element of said third leg block so that the third leg block is stackable beneath and mechanically interlockable with said second leg block.

19. An exercise bench assembly according to claim 18, wherein said first interlocking element of said third leg block is a raised boss on the top of said third leg block and said second interlocking element of said second leg block is a boss receiving recess on the bottom of said second leg block.

20. An exercise bench assembly according to claim 1, further comprising a third leg block having a top and a bottom and a fourth leg block having a top and a bottom, said platform having a first end and a second end, said platform having a first portion adjacent said first end and a second portion adjacent said second end, said second portion having a bottom, said first pair of slots being provided in said first portion, said second portion having an interlocking element adapted to cooperate with said third leg block so that said second portion can be supported by and mechanically interlocked with said third leg block, said third leg block and said fourth leg block being adapted to cooperate with each other so that said fourth leg block is stackable beneath and mechanically interlockable with said third leg block.

21. An exercise bench assembly according to claim 20, wherein said second leg block has a first interlocking element and said first leg block has an interlocking element adapted to cooperate with said first interlocking element of said second leg block so that said second leg block is stackable beneath and mechanically interlockable with said first leg block, and wherein said fourth leg block has a first interlocking element and said third leg block has an interlocking element adapted to cooperate with said first interlocking element of said fourth leg block so that said fourth leg block is stackable beneath and mechanically interlockable with said third leg block.

22. An exercise bench assembly according to claim 21, wherein said first interlocking element of said second leg block is a raised boss on the top of said second leg block, the interlocking element of said first leg block is a boss receiving recess on the bottom of said first leg block, the interlocking element of the second portion is a recess in the bottom of the second portion adapted to receive all or a portion of the top of said third leg block, the first interlocking element of said fourth leg block is a raised boss on the top of said fourth leg block and said interlocking element of said third leg block is a boss receiving recess on the bottom of said third leg block.

23. An exercise bench assembly according to claim 1, wherein said second leg block has a pair of opposing laterally directed projections, said platform has a top surface, and said platform has a second pair of projection receiving slots each of which is in communication with a lower edge of said platform, said second pair of slots being spaced apart from said first pair of projection receiving slots, said second pair of slots being adapted to engage said pair of projections of said second leg block so that said first leg block can engage and support a first portion of said platform while said second leg block engages and supports a second portion of said platform.

24. An exercise bench assembly according to claim 23, each of said first and second leg blocks being adapted to be provided on a substantially planar support surface such that the platform can be mounted on the first and second leg blocks with the first pair of slots engaging the first leg block projections and the second pair of slots engaging the second leg block projections with said top surface of said platform being substantially parallel with said substantially planar support surface.

25. An exercise bench assembly according to claim 24, further comprising a third leg block having a top and a bottom and a fourth leg block having a top and a bottom, said first leg block and said third leg block being adapted to cooperate with each other so that the third leg block is stackable beneath and mechanically interlockable with said first leg block, said second leg block and said fourth leg block being adapted to cooperate with each other so that the fourth leg block is stackable beneath and mechanically interlockable with said second leg block.

26. An exercise bench assembly according to claim 25, wherein said third leg block has a first interlocking element and said first leg block has an interlocking element adapted to cooperate with said first interlocking element of said third leg block so that said third leg block is stackable beneath and mechanically interlockable with said first leg block, and wherein said fourth leg block has a first interlocking element and said second leg block has an interlocking element adapted to cooperate with said first interlocking element of said fourth leg block so that said fourth leg block is stackable beneath and mechanically interlockable with said second leg block.

27. An exercise bench assembly according to claim 26, wherein said first interlocking element of said third leg block is a raised boss on the top of said third leg block, the interlocking element of said first leg block is a boss receiving recess on the bottom of said first leg block, said first interlocking element of said fourth leg block is a raised boss on the top of said fourth leg block, and the interlocking element of said second leg block is a boss receiving recess on the bottom of said second leg block.

28. An exercise bench assembly according to claim 17, wherein each slot and its corresponding projection have cooperating arcuate shapes, the arcuate shapes being effective to allow rotation of the platform with respect to said first leg block.

29. An exercise bench assembly according to claim 1, wherein said platform has four side walls having outer surfaces, and wherein each laterally directed projection does not extend beyond the outer surface of its respective side wall.

30. An exercise bench assembly according to claim 5, wherein each projection receiving slot is contoured to receive and engage (a) at least a portion of a shoulder portion and (b) at least a portion of the laterally directed projection adjacent the shoulder portion.

31. An exercise bench assembly according to claim 25, wherein the first, second, third and fourth leg blocks are substantially identical in size and shape.

32. An exercise bench assembly according to claim 1, wherein said second leg block has two opposing laterally directed projections, wherein said first leg block has a projection receiving channel in communication with a lower edge of the first leg block, the projection receiving channel being adapted to receive a laterally directed projection disposed on said second leg block so that said first and second leg blocks are stackable.

* * * * *

UNITED STATES PATENT AND TRADEMARK OFFICE

CERTIFICATE OF CORRECTION

PATENT NO. : 6,117,051

DATED : September 12, 2000

INVENTOR(S) : Suarez et al.

It is certified that error appears in the above-indentified patent and that said Letters Patent is hereby corrected as shown below:

Col. 4, line 63 delete "lea" and insert therefor --leg--.

Col. 5, line 3 delete "lea" and insert therefor --leg--.

Col. 5, line 7 delete "lea" and insert therefor --leg--.

Col. 5, line 10 delete "lea" and insert therefor --leg--.

Col. 5, line 14 delete "lea" and insert therefor --leg--.

Col. 5, line 22 delete "lea" and insert therefor --leg--.

Col. 5, line 63 after "second" delete --,--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*